US008886079B2

(12) United States Patent
Kawahara

(10) Patent No.: US 8,886,079 B2
(45) Date of Patent: Nov. 11, 2014

(54) IMAGE FORMING APPARATUS AND COOLING DEVICE FOR DEVELOPER MIXING CONTAINER

(71) Applicant: Koji Kawahara, Ibaraki (JP)

(72) Inventor: Koji Kawahara, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/852,306

(22) Filed: Mar. 28, 2013

(65) Prior Publication Data

US 2013/0272743 A1 Oct. 17, 2013

(30) Foreign Application Priority Data

Apr. 16, 2012 (JP) ..... 2012-093058

(51) Int. Cl.
*G03G 21/20* (2006.01)
*G03G 15/08* (2006.01)

(52) U.S. Cl.
USPC ..... 399/94; 399/253

(58) Field of Classification Search
CPC ..... G03G 15/0846; G03G 15/0887; G03G 15/0893; G03G 2215/0838; G03G 2215/085
USPC ..... 399/94, 254, 255
See application file for complete search history.

(56) References Cited

U.S. PATENT DOCUMENTS

| | | | | |
|---|---|---|---|---|
| 8,515,303 | B2 * | 8/2013 | Okano et al. | 399/94 |
| 8,639,150 | B2 * | 1/2014 | Ohmura et al. | 399/94 |
| 2008/0056761 | A1 | 3/2008 | Kawahara et al. | |
| 2009/0123174 | A1 | 5/2009 | Iwata et al. | |
| 2010/0008695 | A1 * | 1/2010 | Okano et al. | 399/94 |
| 2011/0182610 | A1 | 7/2011 | Ohmura et al. | |
| 2011/0188880 | A1 * | 8/2011 | Suzuki et al. | 399/94 |

FOREIGN PATENT DOCUMENTS

| | | | |
|---|---|---|---|
| JP | 2002132121 | A * | 5/2002 |
| JP | 2007293000 | A * | 11/2007 |
| JP | 2009-116198 | | 5/2009 |
| JP | 2011-150243 | | 8/2011 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

An image forming apparatus includes: an image carrier configured to carry an electrostatic latent image thereon; a developing device to render the electrostatic latent image visible with a developer including toner and a carrier; a developer container to contain the developer collected from the developing device; a developer conveyance path through which the developer discharged from the developer container is conveyed to the developing device; a coolant conveyance path to convey a coolant; and a cooling device to cool the developer contained in the developer container when the coolant is contacted to an external surface of the developer container, in which the developer container and the coolant conveyance path are made of different materials and a thermal conductivity of the developer container is higher than that of the coolant conveyance path.

11 Claims, 6 Drawing Sheets

IMAGE FORMING APPARATUS AND COOLING DEVICE FOR DEVELOPER MIXING CONTAINER

CROSS-REFERENCE TO RELATED APPLICATION

The present application claims priority pursuant to 35 U.S.C. §119 from Japanese patent application number 2012-093058, filed on Apr. 16, 2012, the entire disclosure of which is incorporated by reference herein.

BACKGROUND

1. Technical Field

The present invention relates to an image forming apparatus such as a copier, a printer, a facsimile machine, a plotter, and a multifunctional apparatus having one or more capabilities of the above devices, and more specifically, relates to an image forming apparatus including a developer container to stir and mix a developer and circulate the developer therein, separately from a developing device to render an electrostatic latent image formed on an image carrier visible.

2. Related Art

In an image forming apparatus employing an electrophotographic method, provision of the developer container to circulate the developer separately from a developing device to render an electrostatic latent image carried on an image carrier visible allows the developing device to be made compact. Moreover, the provision of a developer stirring member with excellent stirring capability may improve mixture and dispersion of toner to be replenished to the developer contained in the developer container, thereby providing stable image development with the toner having a constant density and charge at a high speed and obtaining a high quality image. Such a technique is disclosed in JP-2009-116198-A, which enables formation of a compact developing device and is suitable for multicolor formation with multiple imaging stations. However, the technique also has the disadvantage of reduced heat dissipation because the developing device has a smaller surface area.

In an image forming apparatus employing an electrophotographic method, an image formed of toner is created on a recording sheet such as a sheet of paper through a series of various processes, from charging, exposure, development, and transfer to fixing. In these processes, heat is generated from various parts and components such as motors, light sources, fixing devices, and the like.

In the developing device itself, heat is generated by a difference in linear speed between a photoreceptor and a developing roller, by an eddy current produced by high-speed rotation of a developing sleeve around a magnet, at a shaft bearing, from friction with a doctor blade when spreading the developer on the developer carrier, and the like. Thus, the developing device itself is a source of heat.

For these reasons, the temperature inside the image forming apparatus increases with continuous printing, changing the properties of the toner inside the developing device, thereby creating various problems, such as a decrease in the fluidity of the developer and agglomeration of the toner. Such problems may prevent proper image formation.

To cope with these problems, JP-2009-116198-A discloses a technique in which air is taken in from an exterior of the image forming apparatus via a fan in order to reduce an increase in the temperature of the developer, the developer discharged from the developer container is conveyed by air pressure to the developing device using the external air having a lower temperature, and the developer is cooled while being conveyed. However, because sufficient cooling time cannot be obtained through such a method, a longer conveyance path of the developer becomes necessary, leading to a reduction in path conveyance efficiency.

JP-2011-150243-A discloses a technique to cool the developer container by disposing the developer container separately from the developing device. When the developer container is cooled, the developer inside can be effectively cooled without the conveyance path to convey the developer being lengthened.

FIG. 5 of the same publication discloses a system to cool the developer container by providing a coolant conveyance path around the exterior of the developer container and by passing the external air through the coolant conveyance path. The developer container is formed of a material with a higher thermal conductivity to move the heat of the developer inside the container swiftly to the outside, where the heat is dissipated by air contacting the exterior of the developer container.

However, because the air as a coolant is itself heated by heat generated at portions of the image forming apparatus other than the developing device, the effectiveness of this system decreases over time.

SUMMARY

Considering the above problems, an optimal image forming apparatus according to the present invention includes: an image carrier configured to carry an electrostatic latent image thereon; a developing device to render the electrostatic latent image visible with a developer including toner and carrier particles; a developer container to contain the developer collected from the developing device; a developer conveyance path through which the developer discharged from the developer container is conveyed to the developing device; a coolant conveyance path to convey a coolant; a cooling device to cool the developer contained in the developer container when the coolant is contacted to an external surface of the developer container. Further, the developer container and the coolant conveyance path are made of different materials and a thermal conductivity of the developer container is higher than that of the coolant conveyance path.

These and other objects, features, and advantages of the present invention will become apparent upon consideration of the following description of the preferred embodiments of the present invention when taken in conjunction with the accompanying drawings.

BRIEF DESCRIPTION OF THE DRAWINGS

FIG. 2 is an oblique view illustrating a developing device, a developer container, and circulation of a developer between;

DETAILED DESCRIPTION

Hereinafter, preferred embodiments according to the present invention are described referring to the accompanying drawings.

Figure 1:
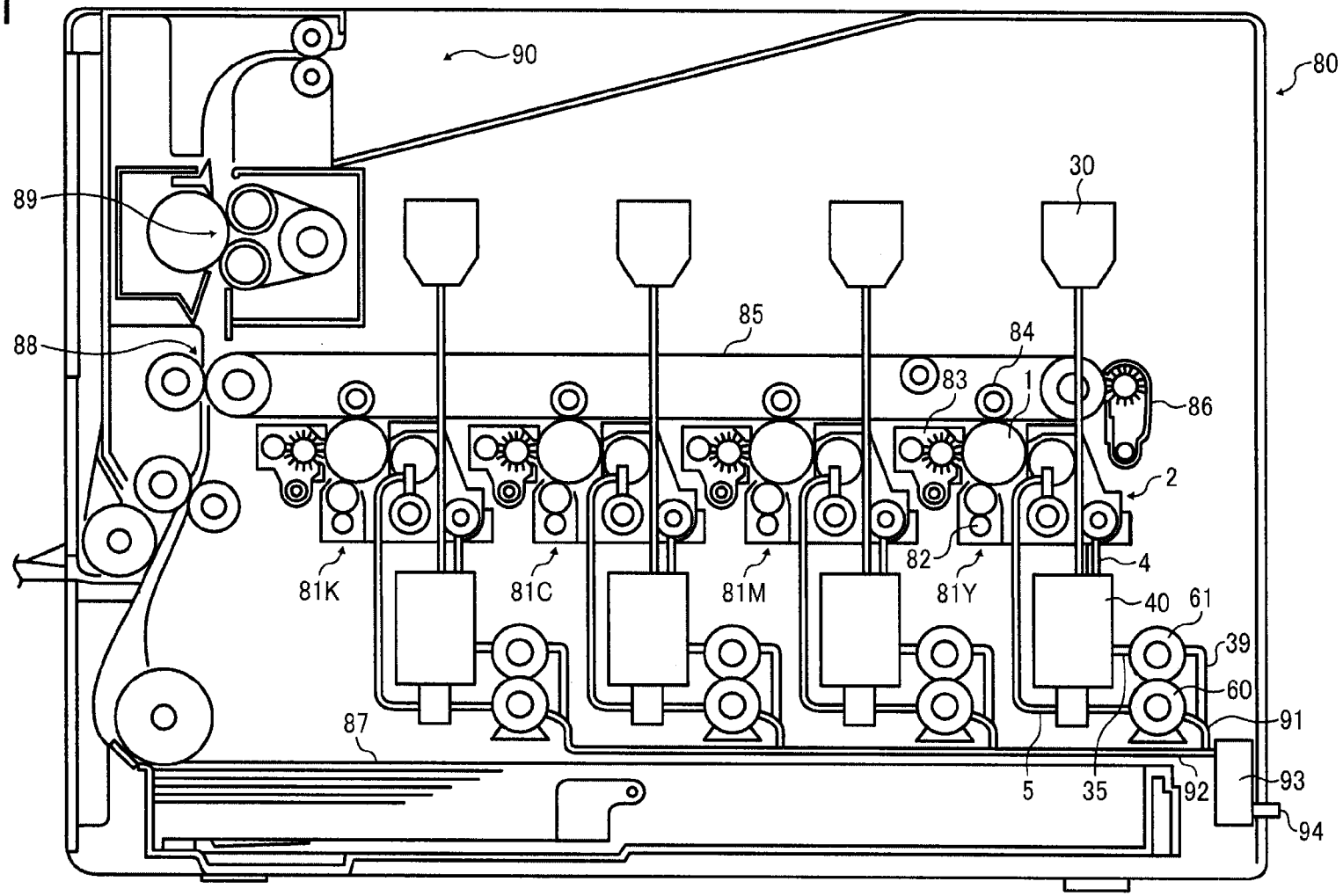
FIG. 1 is a view illustrating an overall structure of an image forming apparatus according to a first embodiment of the present invention.

First, a first embodiment will now be described with reference to FIGS. 1 to 4. FIG. 1 is a view illustrating an overall structure of an image forming apparatus 80 according to the first embodiment.

The image forming apparatus 80 capable of forming a full color image includes an intermediate transfer belt 85 and image forming units 81Y, 81M, 81C, and 81K corresponding to colors yellow (Y), magenta (M), cyan (C), and black (K), respectively, disposed below the intermediate transfer belt 85. Because each image forming unit has a similar structure, the structure of the image forming units will be described using only the image forming unit 81Y as a representative. The image forming unit 81Y includes a drum-shaped photoreceptor 1 as an image carrier, rotatable in the clockwise direction; a charger 82; a developing device 2; a primary transferrer 84; and a cleaner 83.

The photoreceptor 1 is given a uniform electric potential by the charger 82, an electrostatic latent image is formed by an optical writing unit, not shown, on the surface of the photoreceptor 1 corresponding to an image to be formed, and the latent image is developed by the developing device 2, after which a toner image is formed on the photoreceptor 1.

The toner image of each color formed by each image forming unit is sequentially transferred and superimposed on the surface of the intermediate transfer belt 85 by the primary transferrer 84. With this operation, a full color toner image is formed on the intermediate transfer belt 85. The full color toner image is then transferred, by a secondary transferrer 88, to a sheet of recording media supplied from a sheet feed cassette 87, the toner of the toner image formed on the sheet of recording media is fused by heat while passing through a fuser 89, and the color image is fixed onto the sheet of recording media.

As illustrated in FIG. 1, the image forming apparatus 80 further includes a sheet discharger 90 from which the sheet of recording media onto which the image has been fused is discharged, an air suction path 91, an external air suction path 92, a dehumidifier 93, and an air inlet 94.

Normally, the developer to be used in developing is a mixture of toner and carrier particles and is mixed and agitated in the developing device. However, in the present embodiment, a developer container 40 in which the developer is mixed and agitated is disposed at a position apart from the developing device 2 configured to render the electrostatic latent image on the photoreceptor visible.

The developer in the developer container 40 is appropriately agitated so that a density of the toner and a charge are stably adjusted compared to a conventional non-separated one. Thus, the developing device 2 can be formed in a compact shape and stable image formation can be realized.

Hereinafter, a developing system as a whole including the developing device and the developer container will now be described.

Figure 2:
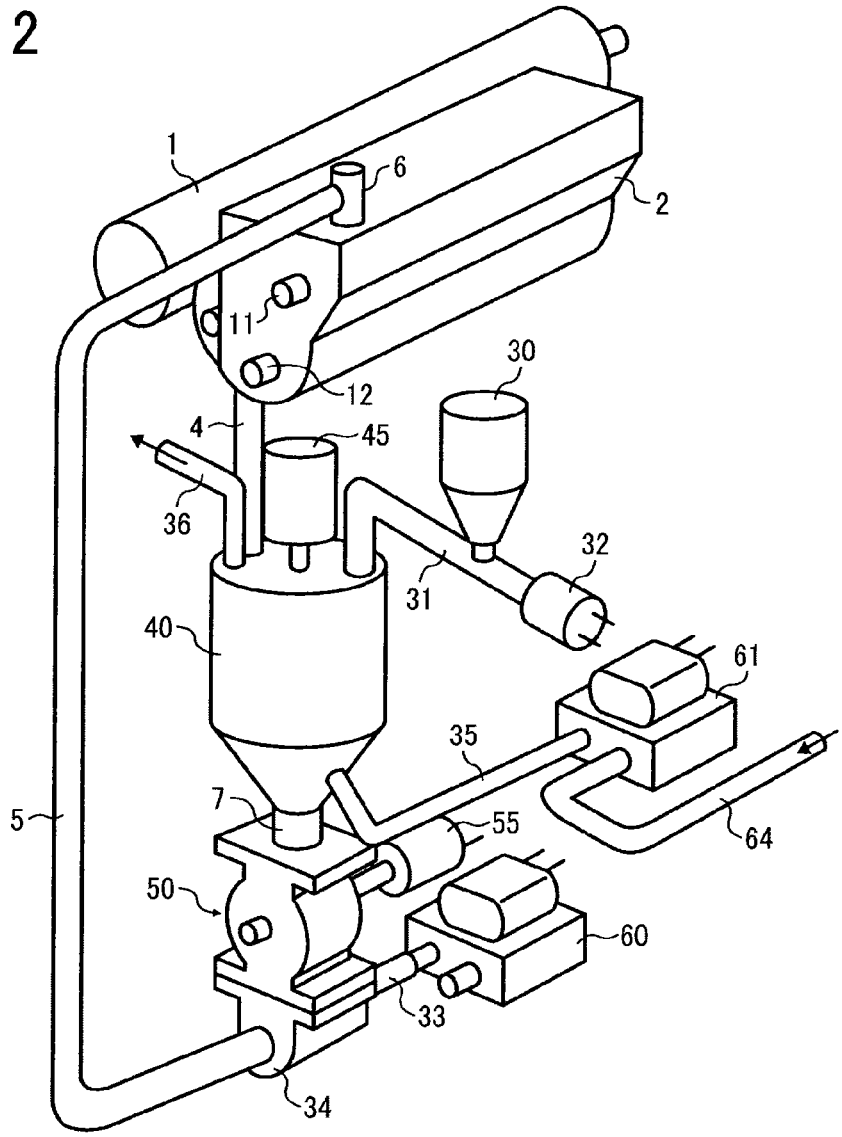

FIG. 2 is an oblique view of the developing system illustrating an overall structure thereof. The developing system includes the developing device 2, the developer container 40, a rotary feeder 50 to quantitatively discharge the developer contained in the developer container 40 via rotation of the rotor 52 (see FIG. 3), and an air pump 60 to convey the discharged developer.

In the bottom of the rotary feeder 50, there is provided a joint pipeline 34. The air pump 60 and the joint pipeline 34 are connected with each other via a pipeline 33. The developer discharged from the rotary feeder 50 joins air sent from the air pump 60 at the joint pipeline 34 and is conveyed to the developing device 2 via a circulation path 5.

The rotary feeder 50, the air pump 60, and the circulation path 5 form developer conveyance means or path.

In FIG. 2, the developing system further includes a motor 32 as a drive source to supply toner and a motor 55 as a drive source for the rotary feeder 50.

Figure 3:
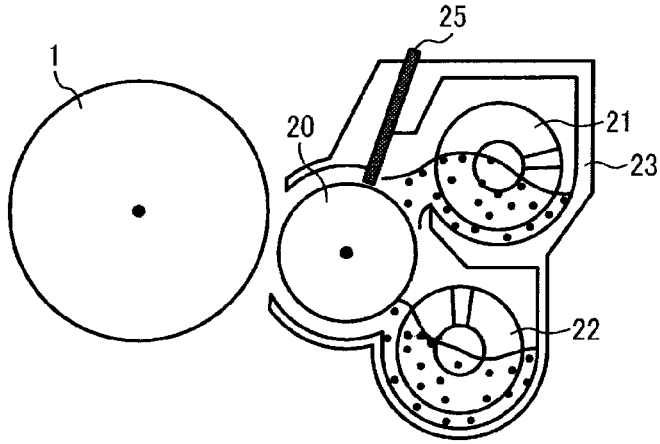
FIG. 3 is a cross-sectional view of the developing device.

FIG. 3 shows an internal structure of the developing device 2. The developing device 2 includes a developing roller 20; conveyance screws 21 and 22, a casing 23, a doctor blade 25, and the like. The developing roller 20 includes a built-in magnet and absorbs and conveys the developer to adhere the toner onto the electrostatic latent image formed on the surface of the photoreceptor 1.

The conveyance screw 21 agitates and conveys the developer from proximal to distal sides in the figure. The conveyance screw 22 is driven to rotate so that the developer is agitated and conveyed from distal to proximal sides in the figure.

Developer ejecting holes, from which the developer collected from the developing device 2 is discharged to a discharge path 4, are provided on the front of the conveyance screw 22. The doctor blade 25 evens out the thickness of the layer of developer adhered on the developing roller 20 to a constant level and the casing 23 covers the developing device 2. The developer used for developing in the developing device 2 falls by its own weight through the discharge path 4 and is fed into the developer container 40 as illustrated in FIG. 2.

As illustrated in FIG. 2, the developing system further includes a developer intake 6 through which the developer cooled in the developer container 40 is returned to the developing device 2; a rotary shaft 11 of the conveyance screw 21; and a rotary shaft 12 of the conveyance screw 22.

Figure 4:
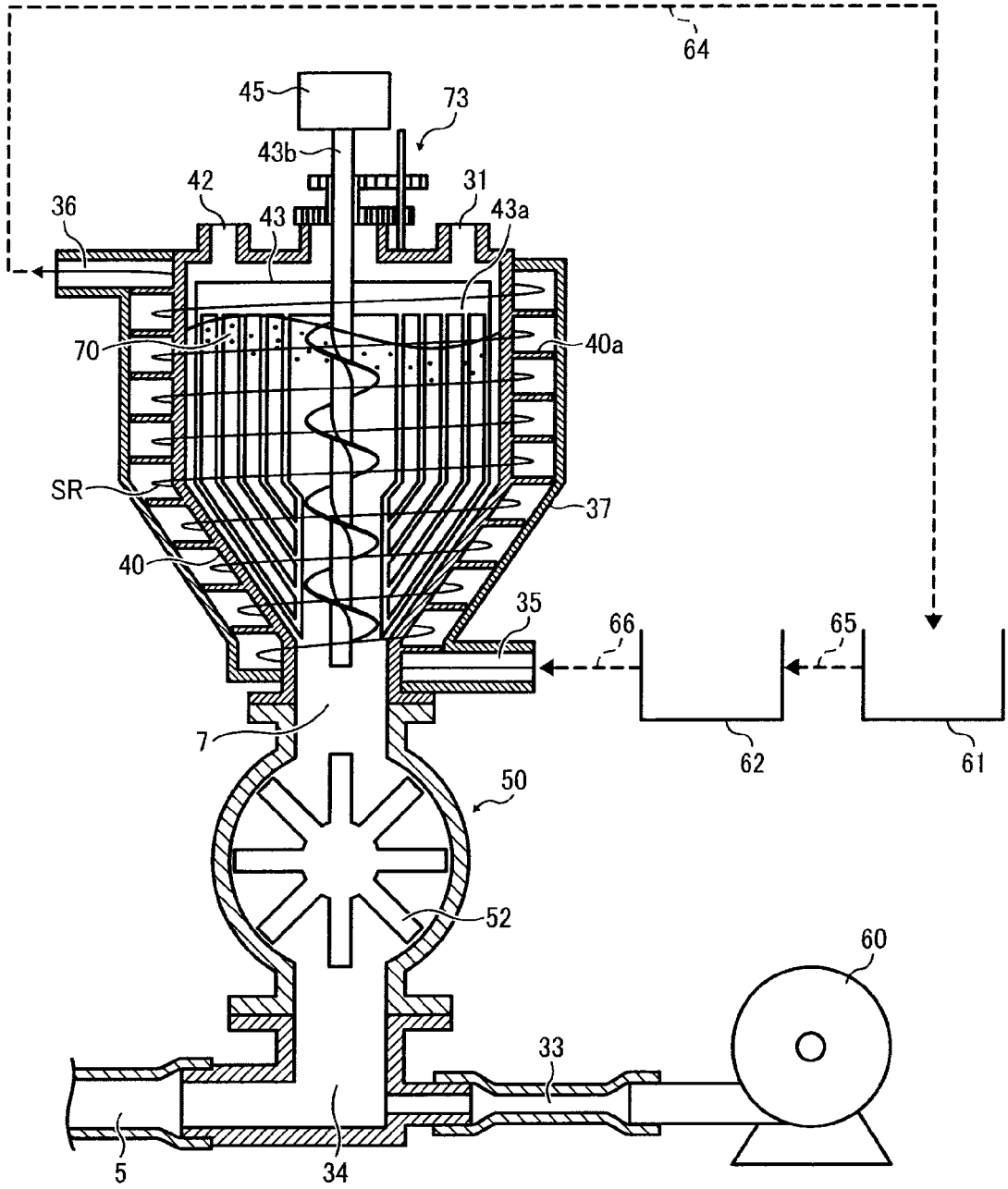
FIG. 4 is a cross-sectional view of the developer container and its circumferential parts.

FIG. 4 is a cross-sectional view of the developer container 40 and the rotary feeder 50 illustrating details of the subject parts.

The developer container 40 includes an agitating part with the shape of a downwardly tapered inverted cone and including a developer replenishing port 42 disposed at an upper side and a discharge port 7 at a bottom side.

Conveyance of the developer from the replenishing port 42 of the developer agitating part of the developer container 40 to the discharge port 7 makes use of the weight of the developer itself, and the developer and the replenished toner are mixed and agitated by an agitating member 43 while falling down from the replenishing port 42. Because developer 70 is always present in the developer agitating part, unmixed developer is not discharged as is.

A spiral auger, not shown, is disposed in a toner supply path 31, one end of which is connected to a toner supply motor 32 as a drive source (see FIG. 2), so that the spiral auger is driven to rotate.

With this structure, as illustrated in FIG. 2, the toner inside a toner hopper 30 is conveyed and resupplied to the developer container 40 and the replenished toner is swiftly mixed and agitated with the developer by the agitating member 43 driven by an agitating motor 45. The agitating member 43 and the agitating motor 45 together form an agitating means.

As illustrated in FIG. 4, the agitating member 43 includes a linear agitating member 43*a* and a spiral agitating member or screw 43*b*. The linear agitating member 43*a* agitates developer in the area from the center of the developer container 40 to the outer area in the radial direction and the screw 43*b* the center area.

The screw 43*b* is connected with the agitating motor 45 and the linear agitating member 43*a* rotates via a reduction gear 73.

The linear agitating member 43*a* is line-symmetrically formed with a plurality of linear members and rotates so that the developer is agitated and mixed with the replenished toner.

The linear member moves part of the developer and the other part of the developer passes though gaps between linear members, thereby accelerating a mixture and agitation of the developer.

Further, because the developer can escape into the gaps, the developer does not receive an excessive stress from a rotation of the linear member. Accordingly, the linear agitating member 43*a* can rotate at high speed and the degree of agitation of the developer improved.

Because the agitating member 43 rotates while shearing the developer, frictional charging between the toner and the carriers is promoted, thereby obtaining a uniform toner charge.

As described above, use of the linear member for agitation provides good dispersion and mixture, increasing the charged potential even though a great deal of toner is replenished.

In addition, because the stress given to the developer is low, the developer is not degraded and toner charge is stabilized in a short time of period. Thus, without causing any background fouling or toner scattering, stable image quality of the formed image can be maintained.

Next, a cooling means or device to cool the developer 70 in the developer container 40 will now be described. In the present embodiment, a coolant conveyance path 37, in which a coolant is guided while contacting the developer container 40, is disposed at a circumference of the developer container 40.

In the present embodiment, water is used as the coolant, which flows in the coolant conveyance path 37. Heat from the developer 70 in the developer container 40 migrates to the water in the coolant conveyance path 37 via the developer container 40 and the water absorbs the heat of the developer 70 in the developer container 40, thereby cooling the developer 70.

Compared to air, water has better thermal conductivity and a higher thermal capacity, and can provide more efficient thermal exchange. The water as a coolant includes an additive including at least an anti-rust agent such as a long life coolant, for example. Addition of the additive prevents rust or corrosion at the coolant conveyance path 37 and a heat radiator 62 and improves durability of the apparatus.

Use of water as a coolant contributes to easy handling and low manufacturing cost.

The heat radiator 62 dissipates the heat transmitted to the water as a coolant. The coolant conveyance path 37 and a pump 61 are connected via a flow path 64 and the pump 61 and the heat radiator 62 are connected via another flow path 65. The heat radiator 62 and the coolant conveyance path 37 are connected via further another flow path 66 and a coolant supply path 35. FIG. 2 does not show the heat radiator 62.

The water as a coolant circulates between the coolant conveyance path 37, the pump 61, and the heat radiator 62 when the pump 61 is driven. When the water circulates, heat transmitted to the water from the developer 70 contained in the developer container 40 is released to air at the heat radiator 62. The heat radiator 62 is positioned at a part in the back of the apparatus exposed to outside air, isolated from the heat from the fixing device in the image forming apparatus.

The coolant conveyance path 37, the pump 61, and the heat radiator 62 form a cooling means or device.

Herein, the developer container 40 is formed of high heat conductive materials such as aluminum and copper so that the heat from the developer 70 contained in the developer container 40 can be effectively transmitted. In addition, the coolant conveyance path 37 is formed of any material having a conductivity lower than that of the material used for the developer container 40, so that the heat from the interior of the image forming apparatus 80 can be reduced. Specifically, the coolant conveyance path 37 is formed of materials which can deflect heat from heat-generating parts other than the developing device in the image forming apparatus; i.e., other than the developer container 40.

Thus, the increase in the temperature of the water as a coolant can be restricted, thereby improving cooling effect.

In addition, a plurality of spiral ribs 40*a* is formed protruding outwardly in the radial direction of the developer container 40. The ribs 40*a* guide the coolant which flows from the coolant supply path 35 to a coolant collection path 36 surrounding an external surface of the developer container 40. With this structure, the coolant is circulated evenly. Further, because the resistance in the flow path is low, a flow path with a high efficiency can be obtained. The formation of ribs provides the additional advantage of increasing a contact surface area to thereby improve cooling.

FIG. 4 shows the flow of water SR in the spiral flow path. In the present embodiment, a structure to spirally convey the coolant is represented by providing ribs on the external surface of the developer container 40. However, the same effect can be obtained by providing ribs on the side of the coolant conveyance path 37.

Figure 5:
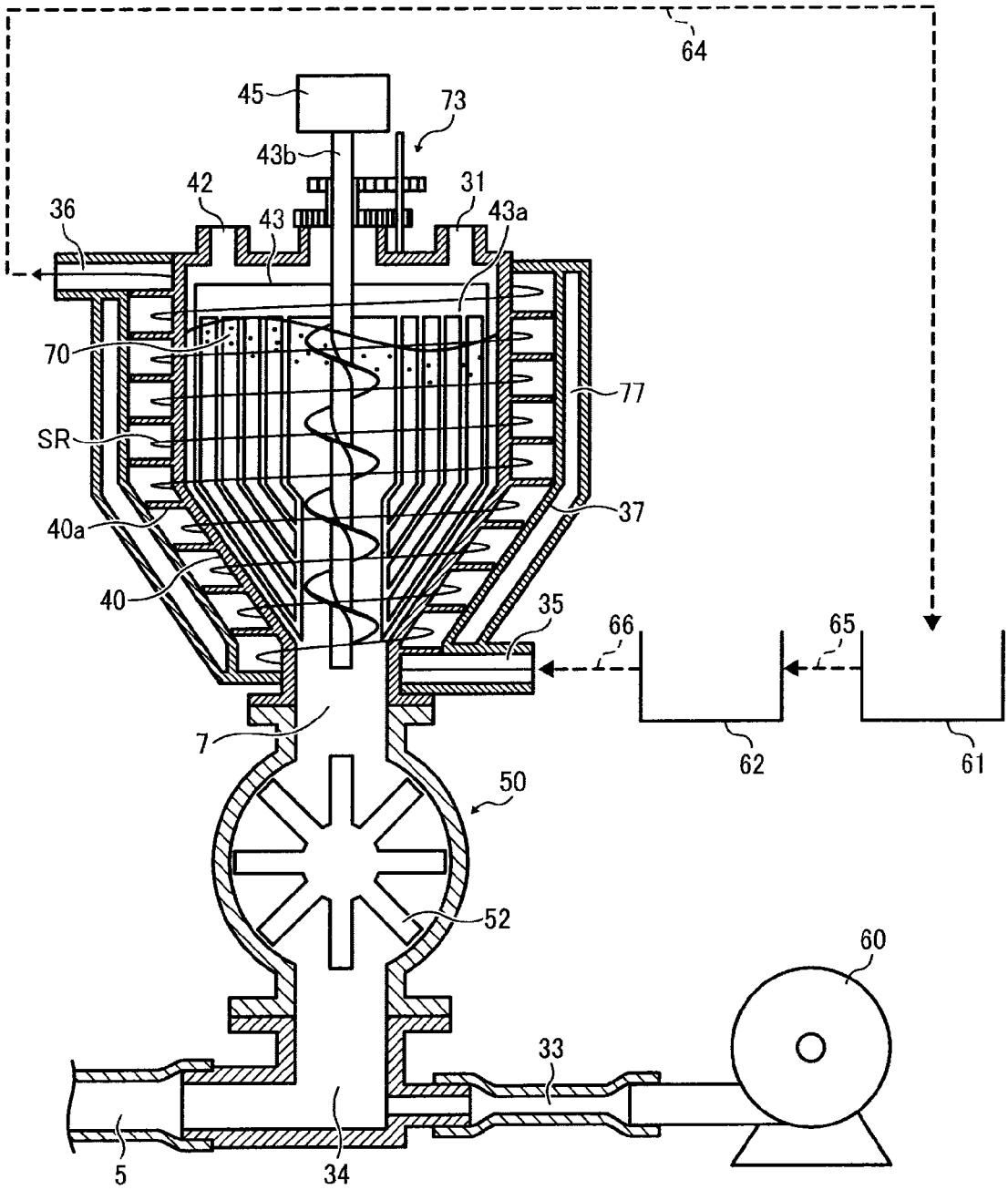
FIG. 5 shows a cross-sectional view of the developer container and its circumferential parts according to a second embodiment of the present invention.

Hereinafter, a second embodiment of the present invention will now be described with reference to FIG. 5. Parts or components already described in the aforementioned description are given the same reference numeral and redundant explanation thereof is omitted.

The coolant conveyance path 37 in the second embodiment has a dual structure, such that a space between an internal layer and an external layer is a vacuum layer 77 as a heat shield. In the vacuum layer, there is no air, so heat is prevented from being transmitted and is circulated effectively.

In the second embodiment, the space between the internal layer and the external layer is formed as the vacuum layer 77 described above; however, even with an air layer, the same heat shielding effect can be obtained. In addition, if the vacuum layer 77 includes internal mirrored or otherwise includes copper foil as in a thermos, heat radiation is effectively reflected so as to absorb the thermal energy.

Figure 6:
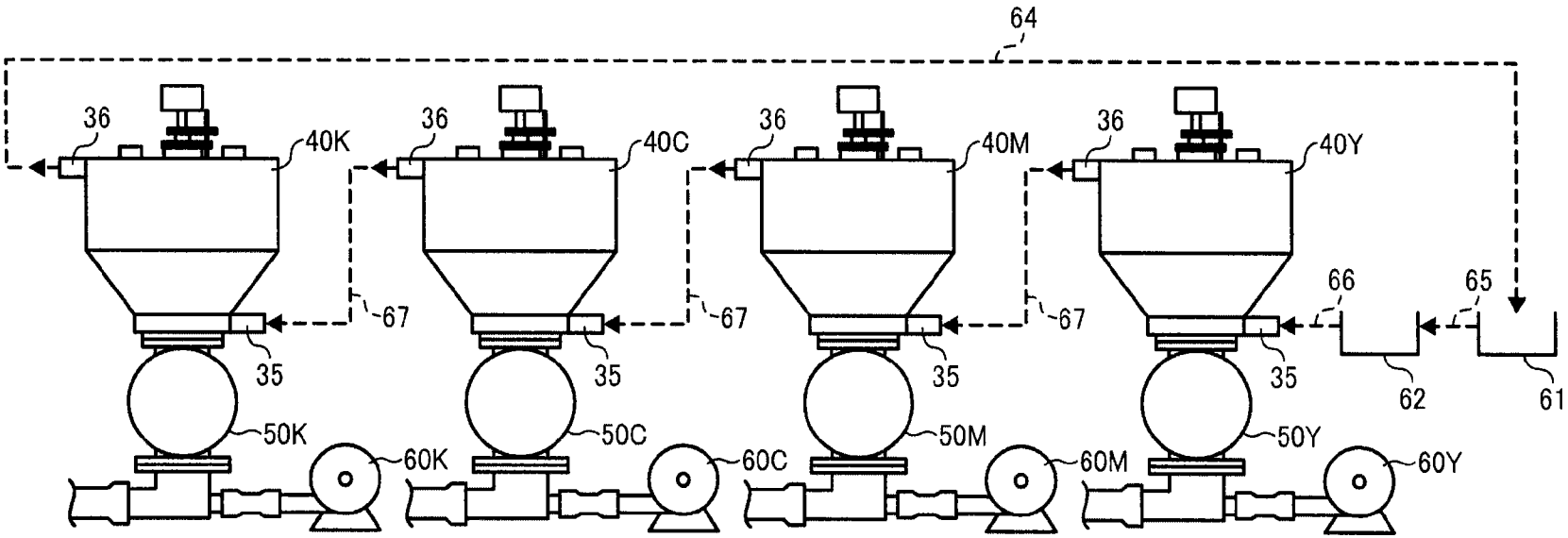
FIG. 6 shows a side overview illustrating a joint structure of the developer container according to a third embodiment of the present invention.

Hereinafter, a third embodiment of the present invention will now be described with reference to FIG. 6. FIG. 6 shows a plurality of photoreceptors to form a multicolor image and a plurality of developing parts and containers are disposed correspondingly. The third embodiment is applied to the thus-configured structure.

In the third embodiment, a plurality of developer containers 40 (40Y, 40M, 40C, and 40K) is connected via a flow path 67. With this configuration, the pump 61 and the heat radiator 62 are used in common, thereby reducing a footprint and manufacturing cost of the apparatus.

Figure 7:
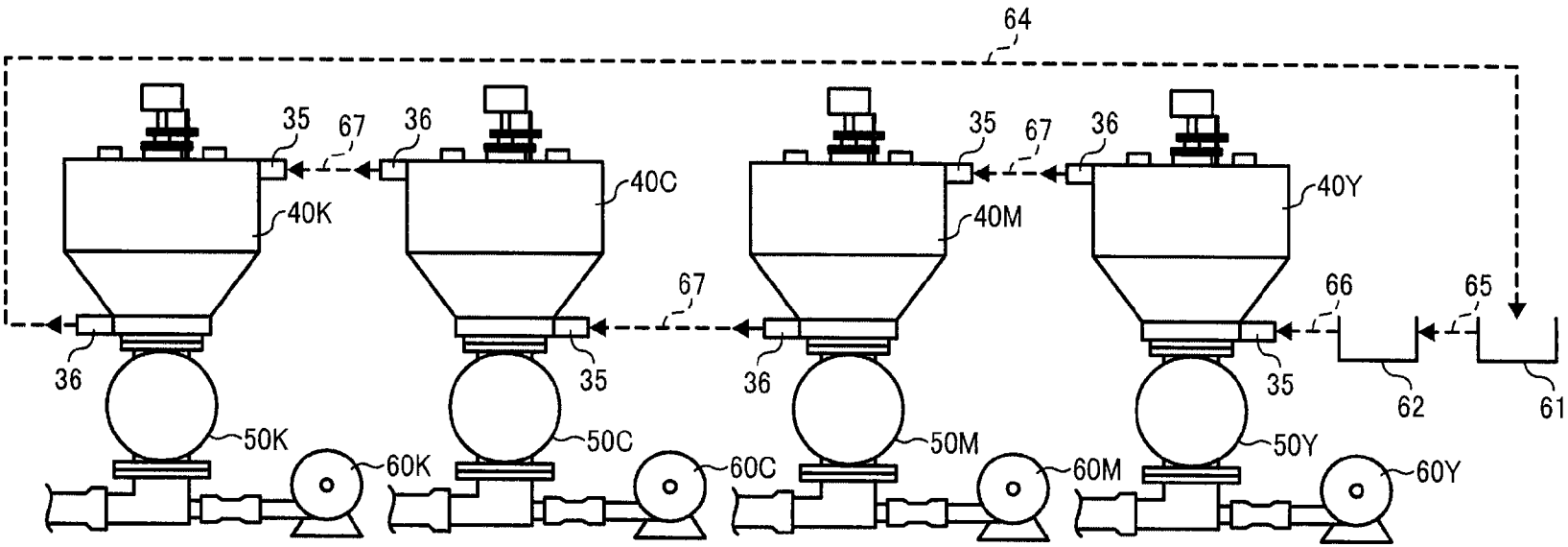
FIG. 7 shows a side overview illustrating a joint structure of the developer container according to a fourth embodiment of the present invention.

A modified example of the third embodiment, that is, a fourth embodiment will now be described with reference to FIG. 7.

In the fourth embodiment, the coolant supply path 35 and the coolant collection path 36 of the plurality of developer containers 40 (40Y, 40M, 40C, and 40K) are reversed alternatingly and the both are connected via the flow path 67 at an upper side or a bottom side. With this structure, the length of the flow path 67 can be shortened compared to the layout in the third embodiment, thereby simplifying the layout and minimizing the heat received in the circulation path.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an image carrier configured to carry an electrostatic latent image thereon;

a developing device to render the electrostatic latent image visible with a developer including toner and carrier;

a developer container to contain the developer collected from the developing device;

a developer conveyance path through which the developer discharged from the developer container is conveyed to the developing device;

a coolant conveyance path to convey a coolant, the coolant conveyance path being delimited by an exterior wall of the developer container and a first wall of the coolant conveyance path which surrounds the exterior wall of the developer container; and a cooling device to cool the developer contained in the developer container when the coolant is contacted to an external surface of the developer container, wherein the developer container and the first wall of the coolant conveyance path are made of different materials and a thermal conductivity of the developer container is higher than a thermal conductivity of the first wall of the coolant conveyance path, and wherein the material of the first wall of the coolant conveyance path deflects heat from heat-generating components other than the developing device in the image forming apparatus.

2. The image forming apparatus as claimed in claim 1, wherein the coolant conveyance path includes a space defined by the first wall of the coolant conveyance path, which is an inner wall, and a second wall, which is an outer wall of the coolant conveyance path and wherein the coolant conveyance path extends around an outside of the developer container.

3. The image forming apparatus as claimed in claim 2, wherein the space is a vacuum.

4. The image forming apparatus as claimed in claim 1, wherein the developer container includes a portion of expanded surface area contacting the coolant.

5. The image forming apparatus as claimed in claim 4, wherein the portion of expanded surface area contacting the coolant is spirally disposed around the developer container.

6. The image forming apparatus as claimed in claim 1, wherein the developer container further comprises an agitator to mix and agitate the developer.

7. The image forming apparatus as claimed in claim 1, wherein the cooling device includes a liquid coolant.

8. The image forming apparatus as claimed in claim 7, wherein the liquid coolant is water.

9. The image forming apparatus as claimed in claim 8, wherein the water includes an anti-rust agent.

10. The image forming apparatus as claimed in claim 1, wherein a plurality of developer containers and a plurality of coolant conveyance paths are disposed for each color of developer and the plurality of coolant conveyance paths of the developer containers are communicated with each other.

11. An image forming apparatus comprising:

an image carrier configured to carry an electrostatic latent image thereon;

a developing device that renders the electrostatic latent image visible with a developer including toner and carrier;

a developer container that contains the developer collected from the developing device;

a developer conveyance path through which the developer discharged from the developer container is conveyed to the developing device;

a cooling device that cools the developer contained in the developer container via contact between a coolant flowing in the cooling device and an external surface of the developer container; and a coolant conveyance container having a coolant conveyance path therein for conveying the coolant around the developer container, and a vacuum space, wherein the coolant conveyance container includes an inner wall and an outer wall, such that the coolant conveyance path is delimited by the external surface of the developer container and the inner wall of the coolant conveyance container, and such that the vacuum space is delimited by the inner wall and the outer wall, and wherein the developer container and the inner and outer walls of the coolant conveyance container are made of different materials and a thermal conductivity of the material of the developer container is higher than a thermal conductivity of inner and outer walls of the coolant conveyance container.

* * * * *